US007246790B1

(12) United States Patent
Francoeur et al.

(10) Patent No.: US 7,246,790 B1
(45) Date of Patent: Jul. 24, 2007

(54) HOIST SYSTEM

(76) Inventors: Ulric Francoeur, 71 Cranberry Green SE., Calgary (CA) T3M 1L4; Robert Corbiel, #11 Imperial Close, Olds (CA) T4H 1M6

( * ) Notice: Subject to any disclaimer, the term of this patent is extended or adjusted under 35 U.S.C. 154(b) by 0 days.

(21) Appl. No.: 11/381,855

(22) Filed: May 5, 2006

(51) Int. Cl.
*B66D 1/36* (2006.01)

(52) U.S. Cl. ..... 254/334

(58) Field of Classification Search ..... 254/323, 254/324, 334
See application file for complete search history.

(56) References Cited

U.S. PATENT DOCUMENTS

| | | | | | |
|---|---|---|---|---|---|
| 1,687,170 | A | | 10/1928 | Mattern | |
| 3,596,969 | A | * | 8/1971 | La Rosa, Jr. | 294/81.3 |
| 3,776,514 | A | | 12/1973 | Eggleton, Jr. et al. | |
| 4,084,794 | A | | 4/1978 | Wallace | |
| 4,102,295 | A | * | 7/1978 | Crook et al. | 116/281 |
| 4,223,932 | A | | 9/1980 | Gonsalves | |
| 4,251,060 | A | | 2/1981 | Suzuki et al. | |
| 4,671,554 | A | * | 6/1987 | Lancelot | 294/89 |
| 4,689,994 | A | * | 9/1987 | Savinell et al. | 73/634 |
| 4,769,960 | A | * | 9/1988 | Zipf et al. | 52/125.4 |
| 4,888,922 | A | * | 12/1989 | Lancelot | 52/124.2 |
| 5,125,861 | A | | 6/1992 | Freeman | |
| 5,226,687 | A | | 7/1993 | Currie | |
| 5,640,876 | A | | 6/1997 | Erwin | |
| 5,898,987 | A | | 5/1999 | Onofrio | |
| 6,039,500 | A | | 3/2000 | Kwon | |
| 6,250,483 | B1 | * | 6/2001 | Frommer | 212/180 |
| 6,425,727 | B1 | * | 7/2002 | Hood | 414/543 |
| 6,491,329 | B1 | | 12/2002 | Smith | |
| 6,612,549 | B1 | * | 9/2003 | Woods, Jr. | 254/323 |
| 6,742,770 | B1 | | 6/2004 | Vassioukevitch | |
| 6,769,669 | B2 | * | 8/2004 | Cook et al. | 254/329 |
| 6,871,841 | B2 | * | 3/2005 | Brestelli et al. | 254/323 |

* cited by examiner

*Primary Examiner*—Emmanuel M Marcelo
(74) *Attorney, Agent, or Firm*—David A. Guerra

(57) ABSTRACT

A hoist system for raising, lowering, or applying a pulling force to an object or equipment attached thereto. The hoist system has a hoist, a hoist adapter unit attached to the hoist, and a pull pin assembly. The hoist has a frame and a line, cable, or chain which is used to raise, lower, or manipulate an object attached thereto. The hoist adapter unit is removably attached to the frame of the hoist, and it is configured to contact either the object to be manipulated or a stationary object. The pull pin assembly is removably attached to the line of the hoist and to the object other than the object in contact with the hoist adapter.

20 Claims, 14 Drawing Sheets

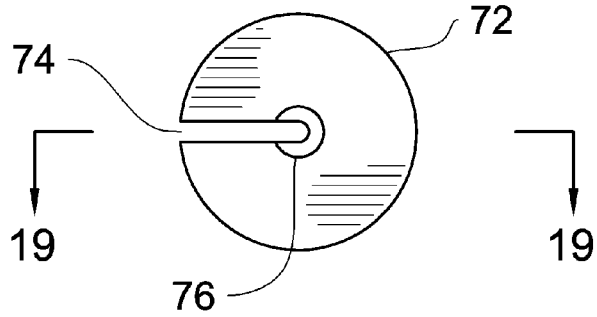
FIG. 18
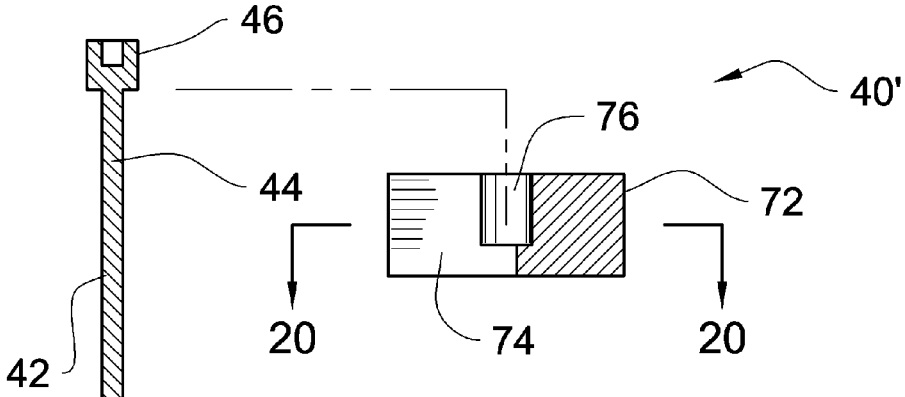
FIG. 19
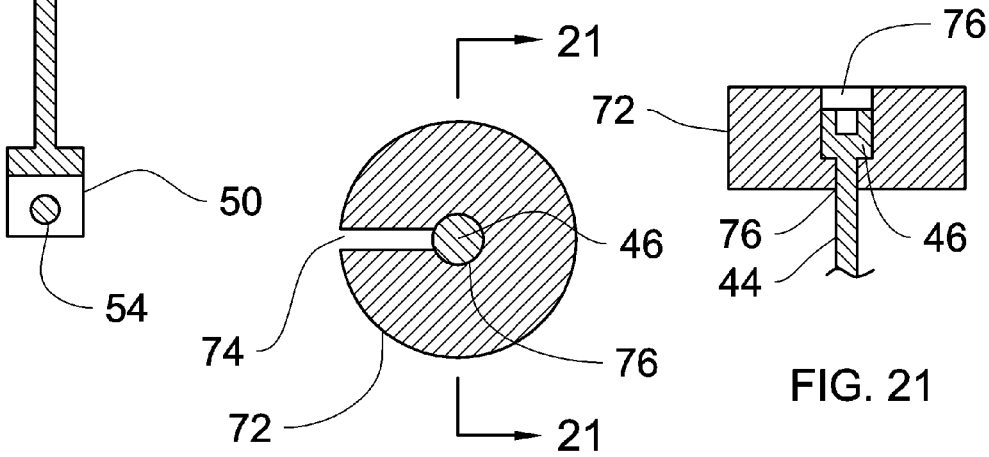
FIG. 21
FIG. 20

HOIST SYSTEM

BACKGROUND OF THE INVENTION

1. Field of the Invention

The present invention relates to a hoist system for use in connection with raising, lowering, or applying a pulling force to an object attached thereto. The hoist system has particular utility in connection with adapting a hoist for raising and lowering equipment.

2. Description of the Prior Art

Hoist systems are desirable for raising, lowering, or applying a pulling force to objects and equipment. Particularly in lowering or installing heavy objects overhead by using a hoist that can attach directly to the objects mounting system.

The use of hoist, lifting, or jack devices are known in the prior art. For example: U.S. Pat. No. 4,251,060; U.S. Pat. No. 3,776,514; U.S. Pat. No. 5,226,687; U.S. Pat. No. 5,640,876; U.S. Pat. No. 6,491,329; U.S. Pat. No. 4,084,794; U.S. Pat. No. 6,039,500; U.S. Pat. No. 5,125,861; U.S. Pat. No. 1,689,170; U.S. Pat. No. 4,223,932; U.S. Pat. No. 6,742,770; U.S. Pat. No. 5,898,987; and United Kingdom Patent Number GB 109(56)93.

While the above-described devices fulfill their respective, particular objectives and requirements, the aforementioned patents do not describe a hoist system that allows adapting a hoist for raising and lowering equipment. The above-identified patents make no provision for a system for allowing a hoist to be used on a variety of objects while securing the hoist to the object's or equipment's own mounting system.

Therefore, a need exists for a new and improved hoist system that can be used for adapting a hoist for raising and lowering equipment. In this regard, the present invention substantially fulfills this need. In this respect, the hoist system according to the present invention substantially departs from the conventional concepts and designs of the prior art, and in doing so provides an apparatus primarily developed for the purpose of adapting a hoist for raising and lowering equipment.

SUMMARY OF THE INVENTION

In view of the foregoing disadvantages inherent in the known types of hoist or lifting devices now present in the prior art, the present invention provides an improved hoist system, and overcomes the above-mentioned disadvantages and drawbacks of the prior art. As such, the general purpose of the present invention, which will be described subsequently in greater detail, is to provide a new and improved hoist system and method which has all the advantages of the prior art mentioned heretofore and many novel features that result in a hoist system which is not anticipated, rendered obvious, suggested, or even implied by the prior art, either alone or in any combination thereof.

To attain this, the present invention essentially comprises a hoist system for moving a first object in relation to a second object. The hoist system has a hoist, a hoist adapter unit attached to the hoist, and a pull pin assembly. The hoist has a frame and a line, cable, or chain which is used to raise, lower, or manipulate an object attached thereto. The hoist adapter unit is removably attached to the frame of the hoist, and it is configured to contact either the object to be manipulated or a stationary object. The pull pin assembly is removably attached to the line of the hoist and to the object other than the object in contact with the hoist adapter.

The hoist adapter unit has a hollow body, a top plate, a bottom plate, and a mounting plate. The mounting plate has a hole defined therethrough to receive a fastener, such as a bolt, from the frame of the hoist thereby removably attaching the hoist adapter unit to the hoist. The top and bottom plates each have an opening defined therein to receive the line of the hoist therethrough. Additionally, the hollow body and the openings in the top and bottom plates are adapted to receive the pull pin assembly therein.

There has thus been outlined, rather broadly, the more important features of the invention in order that the detailed description thereof that follows may be better understood and in order that the present contribution to the art may be better appreciated.

The invention may also include a variety of lifting plates attachable to the pull pin. Furthermore, multiple embodiments for the pull pin assembly can be used in combination with the hoist adapter unit, such as but not limited to, an expanding pin, a flip pin featuring a swiveling arm, and a threaded swiveling pin. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hoist system that has all of the advantages of the prior art hoist or lifting devices and none of the disadvantages.

It is another object of the present invention to provide a new and improved hoist system that may be easily and efficiently manufactured and marketed.

An even further object of the present invention is to provide a new and improved hoist system that has a low cost of manufacture with regard to both materials and labor, and which accordingly is then susceptible of low prices of sale to the consuming public, thereby making such hoist system economically available to the buying public.

Still another object of the present invention is to provide a new hoist system that provides in the apparatuses and methods of the prior art some of the advantages thereof, while simultaneously overcoming some of the disadvantages normally associated therewith.

Even still another object of the present invention is to provide a hoist system for adapting a hoist for raising and lowering equipment. This allows for a safe and easy way to remove or install overhead objects, such as but limited to, an undercarriage belly pan for tractors or vehicles. Using the hoist system significantly increases worker safety as well as decrease labor. Additionally, the hoist system can be adapted to remove or install transmissions, engines, and excavation scrapers and teeth to buckets and loaders.

Lastly, it is an object of the present invention to provide a new and improved method of raising and lowering objects using the hoist system. A user would insert the pull pin assembly through the object to be manipulated and then attached to the second object. The pull pin assembly is adapted to be attached into pre-existing mounting holes or fixtures. The hoist adapter unit supports the weight of the object to be manipulated. Multiple hoist systems can be used for large objects. The user would then activate the hoist to either raise or lower the object. The hoist can either be powered or manually operated.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 18 is a top elevational view the lift plate of the hoist system of the present invention.

FIG. 19 is an exploded cross sectional view of the pull pin and lift plate of the hoist system of the present invention taken along line 19 in FIG. 18.

FIG. 20 is a cross sectional view of the pull pin and lift plate of the hoist system of the present invention taken along line (20) in FIG. 19.

FIG. 21 is a cross sectional view of the pull pin and lift plate of the hoist system of the present invention taken along line 21 in FIG. 20.

The same reference numerals refer to the same parts throughout the various figures.

DESCRIPTION OF THE PREFERRED EMBODIMENT

Figure 1:
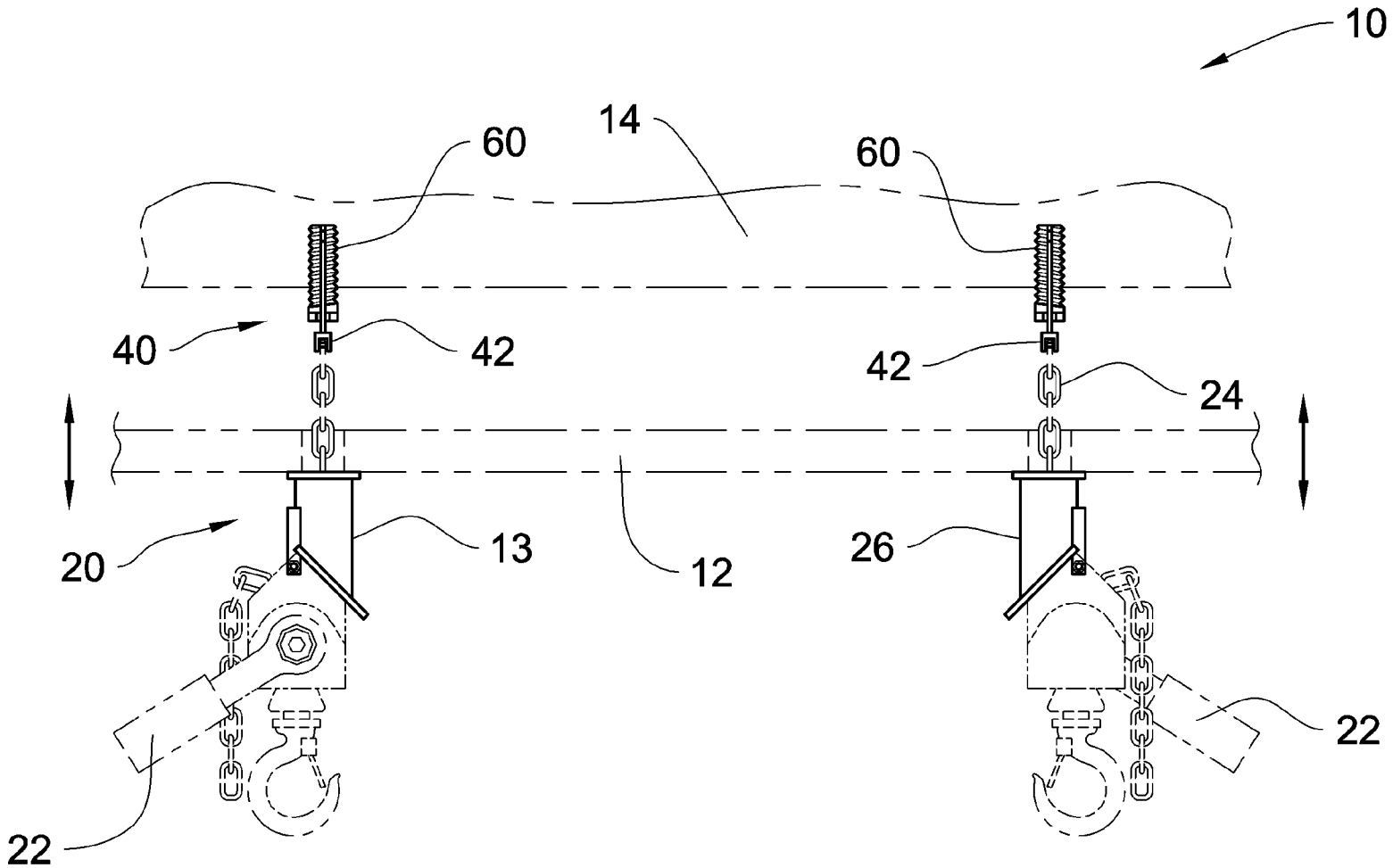
FIG. 1 is a front elevational view of the preferred embodiment of the hoist system constructed in accordance with the principles of the present invention.

Referring now to the drawings, and particularly to FIGS. 1-31, a preferred embodiment of the hoist system of the present invention is shown and generally designated by the reference numeral 10.

In FIG. 1, a new and improved hoist system 10 of the present invention for raising, lowering, or manipulating a first object 12 in relation to a second object (14) is illustrated and will be described. More particularly, the hoist system 10 has a hoist adapter unit (20) removably attached to a hoist (22), and pull pin assembly (40) removably attached to a line (24) of the hoist (22). The pull pin assembly (40) includes a pull pin (42) and an adapter pin (60). The hoist (22) can be any suitable hoist or come-along, which can be powered manually, or motorized. The line (24) of the hoist (22) can be any suitable line, such as but not limited to a cable, chain, rope, or tether. The objects (12, 14), can be but are not limited to, a vehicle belly pan and chassis, an excavation bucket and teeth or scraper, an overhead support and a paneling, or any object or equipment needing to be raised or lowered in relation to another object or equipment.

It can be appreciated that multiple hoist systems 10 can be used for large or heavy objects or equipments (12, 14).

Figure 2:
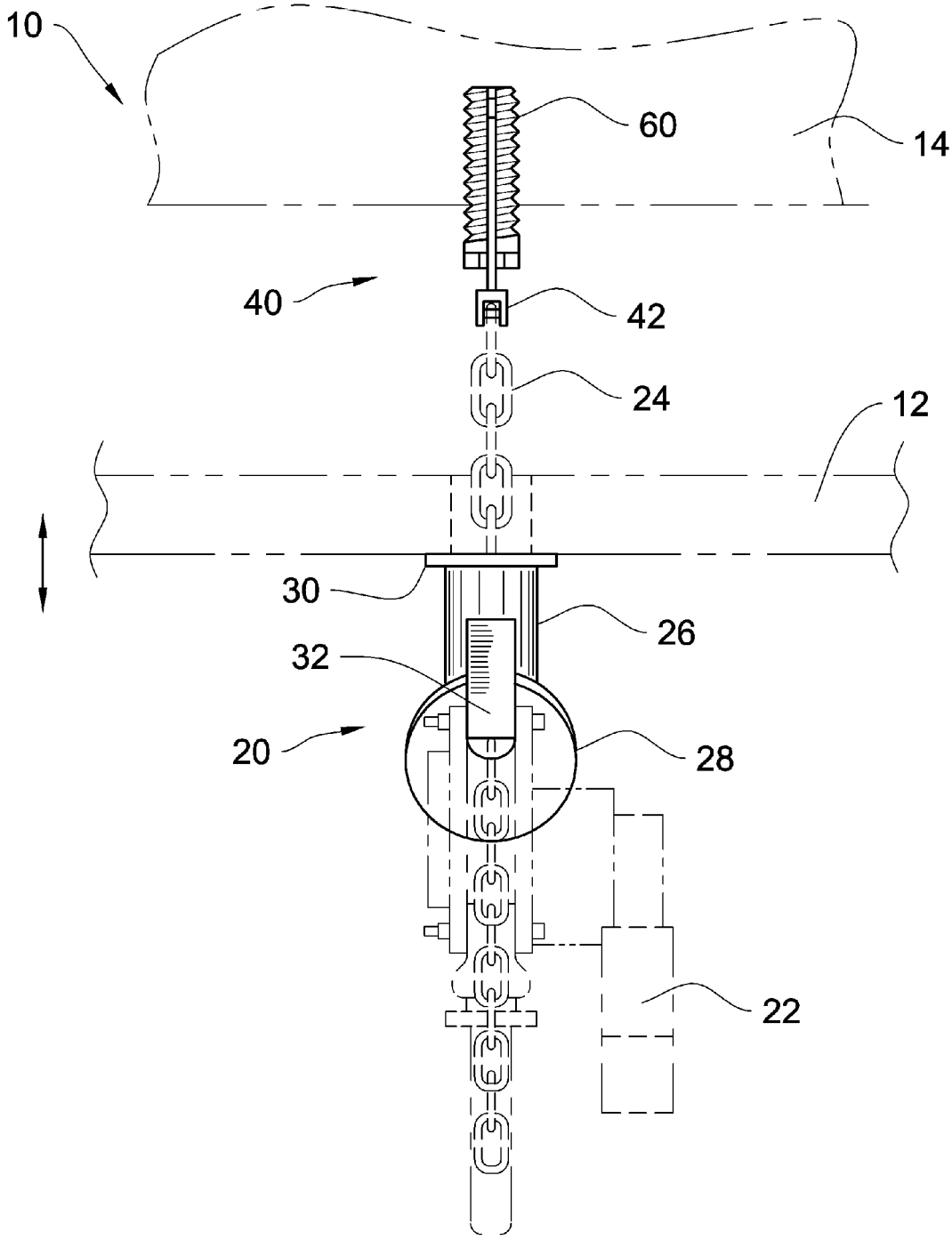
FIG. 2 is a side elevational view of the hoist system of the present invention.
Figure 3:
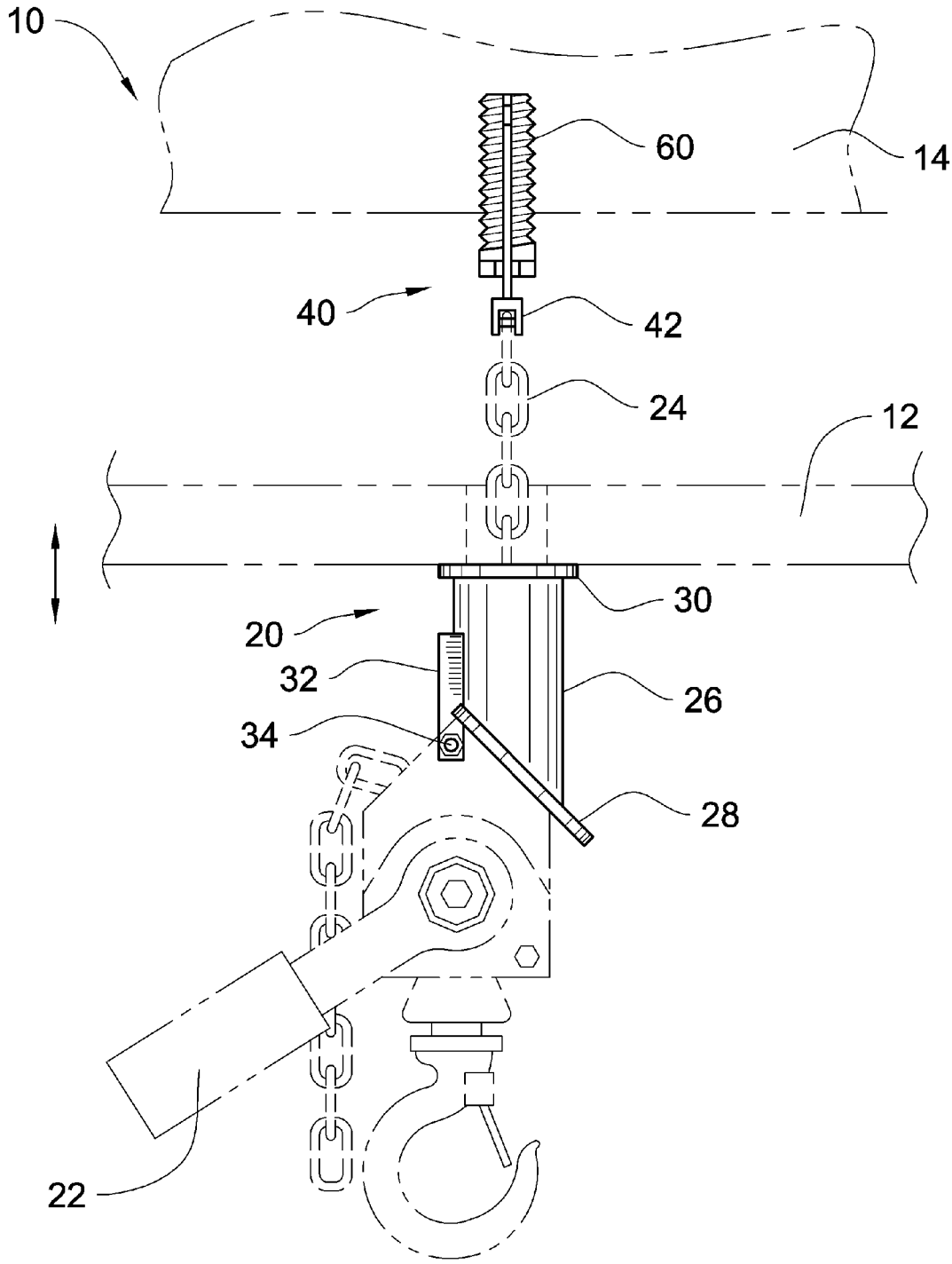
FIG. 3 is a front elevational view of the hoist system of the present invention.
Figure 4:
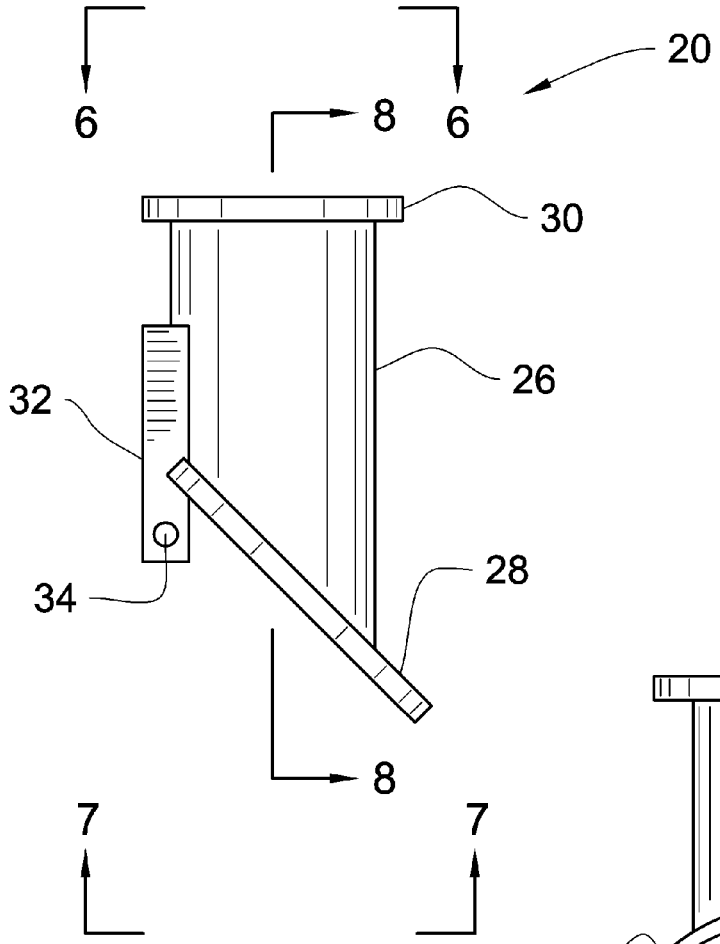
FIG. 4 is a front elevational view of the hoist adapter unit of the hoist system of the present invention.
Figure 5:
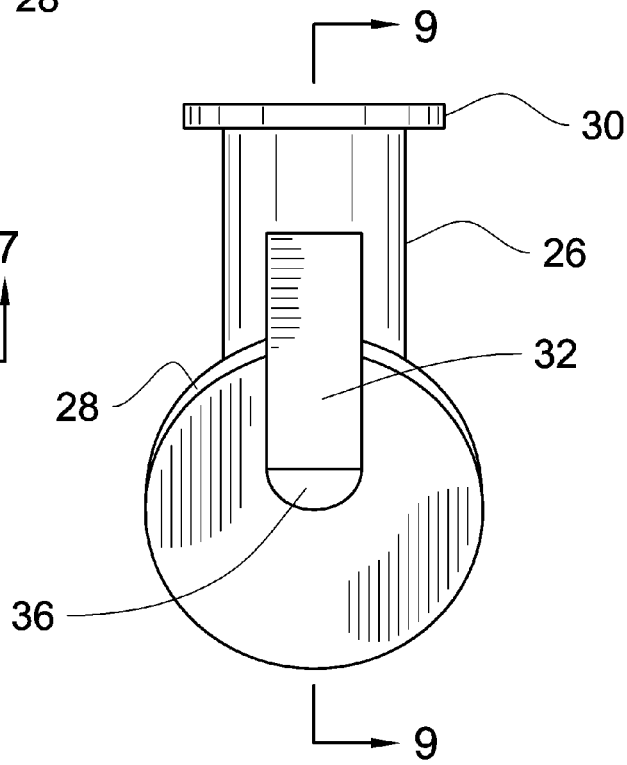
FIG. 5 is a side elevational view of the hoist adapter unit of the hoist system of the present invention.
Figure 6:
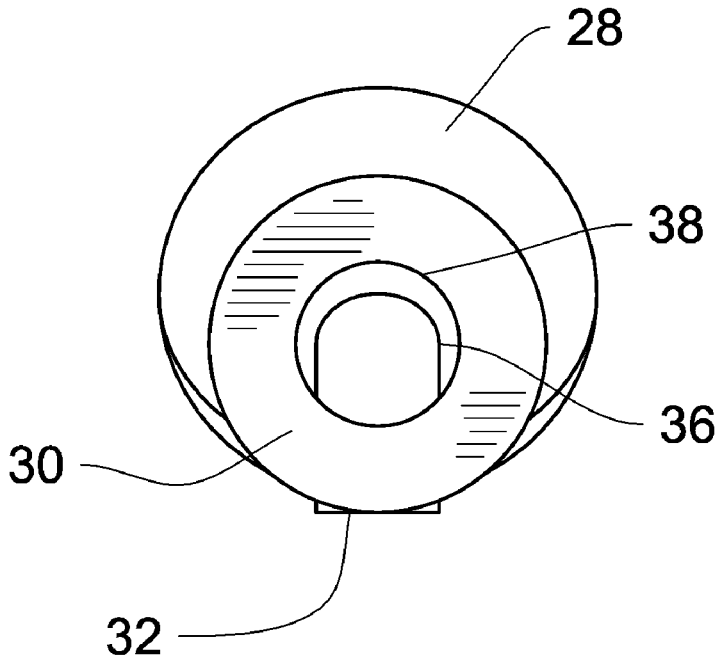
FIG. 6 is a top elevational view of the hoist adapter unit of the hoist system of the present invention.
Figure 7:
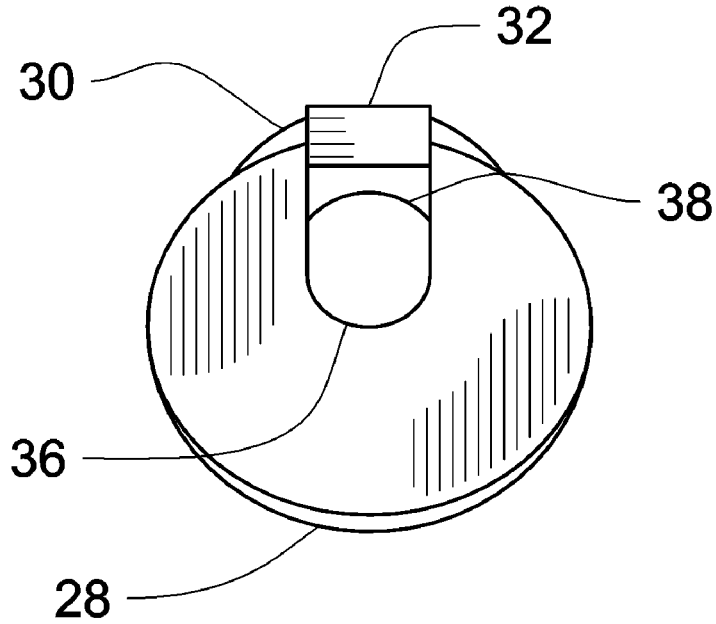
FIG. 7 is a bottom elevational view of the hoist adapter unit of the hoist system of the present invention.

The hoist adapter unit (20) has a hollow body (26), a top plate (30), a bottom plate (28), and a mounting plate (32). The mounting plate (32) features a hole (34) defined therethrough to receive a fastener or mounting structure from the frame of the hoist (22), thereby removably attaching the hoist adapter unit (20) to the hoist (22). The bottom plate (28) can be orientated at an angle so as to correspond to any angle or configuration of the frame of the hoist (22), as best illustrated in FIGS. 2 and 3. The first object (12) is then supported by the top plate (30).

The pull pin (42) is removably attached to the line (24) of the hoist (22). The adapter pin (60) is removably attached to the pull pin (42) and to the second object or equipment (14). Hence, the weight of the first object 12 is supported by the top plate (30) of the hoist adapter unit (20), and the weight of the first object (12) and the hoist system 10 is supported by the adapter pin (60) and second object (14) connection. It can be appreciated that the adapter pin (60) can be attached to the first object (12), and the hoist adapter unit (20) attached to the second object 14. Either arrangement can be used to raise, lower, or provide a pulling force between the first and second objects (12, 14).

Referring to FIGS. 4-9, a detailed description of the hoist adapter unit (20) is provided. The hoist adapter unit (20) is preferably made of metal, but any suitable material can be used, such as but not limited to, alloys, plastics, and composites. The hollow body (26) is substantially cylindrical in configuration, but it any other geometric shape can be used so as to provide the desired strength and rigidity to support the first or second objects (12, 14). The top plate (30) is rigidly secured to the top of the hollow body (26), and the bottom plate (28) is rigidly secured to the bottom of the hollow body (26). The mounting plate (32) is rigidly secured to a side of the hollow body (26) with the mounting plate hole (34) located adjacent the bottom plate (28). The top and bottom plates (28), (30) are planar and have a substantially circular configuration, but any suitable configuration can be used so as to correspond to either the first object (12) or the second object (14).

Figure 8:
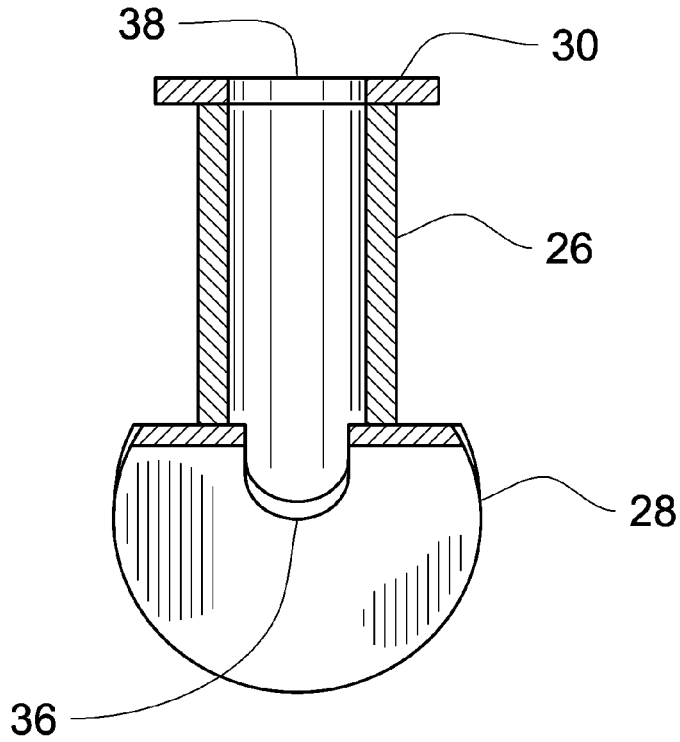
FIG. 8 is a cross sectional view hoist adapter unit of the hoist system of the present invention taken along the line 8 in FIG. 4.
Figure 9:
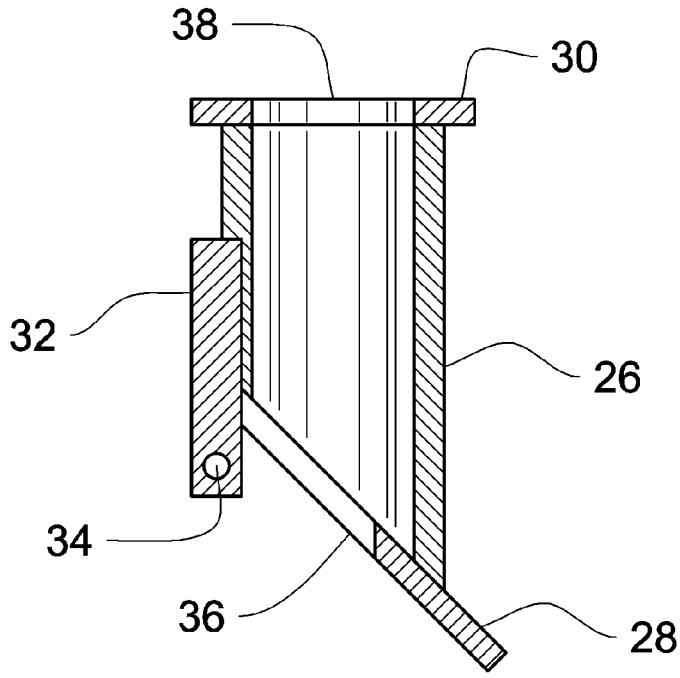
FIG. 9 is a cross sectional view of the hoist adapter unit of the hoist system of the present invention taken along the line 9 in FIG. 5.

The bottom plate (28) has an opening or slot (36) centrally defined therein. The opening (36) is in communication with the hollow interior of the hollow body (26). Additionally, the top plate (30) has an opening or slot (38) centrally defined therein, and in communication with the hollow interior of the hollow body (26), as best illustrated in FIGS. 8 and 9. The hollow interior of the hollow body (26) and the openings (36, 38) are adapted to receive the pull pin assembly (40) therein. The opening (36) is adapted to allow the line (24) to pass therethrough.

Figure 10:
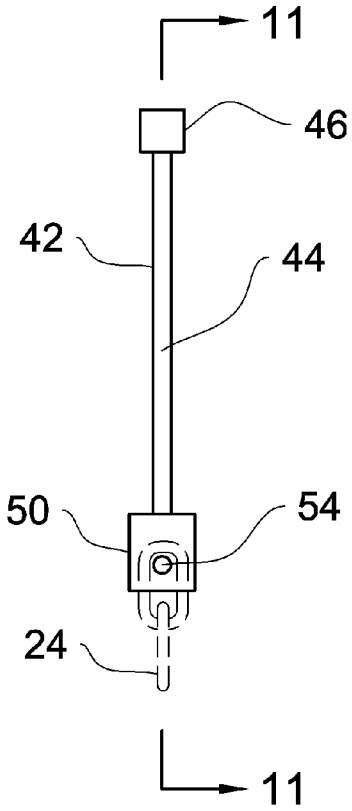
FIG. 10 is a front elevational view of the pull pin of the hoist system of the present invention.
Figure 11:
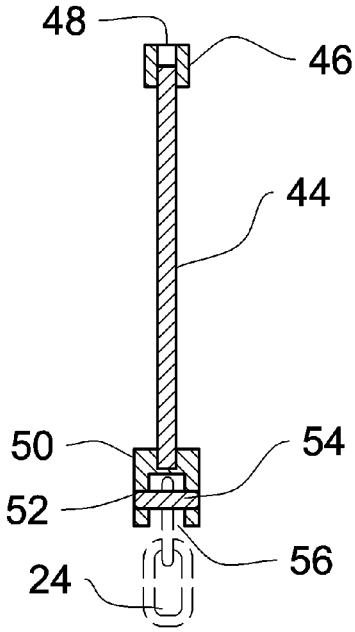
FIG. 11 is a cross sectional view of the pull pin of the hoist system of the present invention taken along line 11 in FIG. 10.

The pull pin (42) illustrated in FIGS. 10 and 11, has a shaft (44), a head (46) attached to one end of the shaft (44), and an attachment end (50) rigidly or removably attached to the end of the shaft (44) opposite the head (46). The head (46) features a bore (48) therethrough to receive the shaft (44) therein. The attachment end (50) has a slot (56) to receive the line (24) therein, and a bore (52) to receive and secure a pin (54). The pin (54) can be inserted through an eye of the line or chain (24), thereby removably securing the line or chain (24) to the attachment end (50) of the pull pin (42). It can be appreciated that the slot (56) can be adapted to receive any size line or chain (24). The pull pin (42) is preferably made of metal, but any suitable material can be used, such as but not limited to, alloys, plastics, and composites. The size of the head (46) is larger than the size of the shaft (44). It can be appreciated that the shaft (44), the head (46), and the attachment end (50) can be fabricated as one solid unit.

Figure 12:
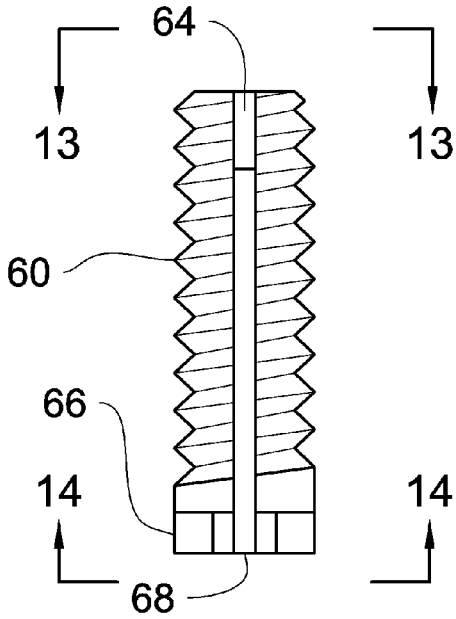
FIG. 12 is a front elevational view of the adapter pin of the hoist system of the present invention.
Figure 13:
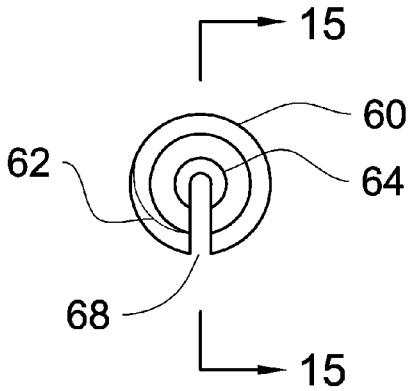
FIG. 13 is a top elevational view of the adapter pin of the hoist system of the present invention.
Figure 14:
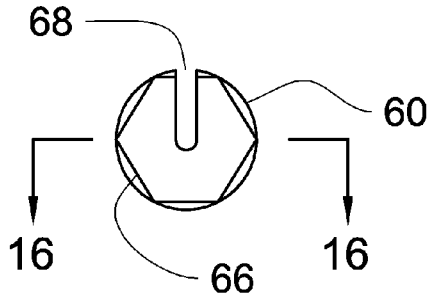
FIG. 14 is a bottom elevational view of the adapter pin of the hoist system of the present invention.

The adapter pin (60), as best illustrated in FIGS. 12-14 has a threaded shaft (62), an opening (64), a fastener end (66), and a slot (68). The threaded shaft (62) can be any size and pitch thread, and can also be either metric SI or standard. The fastener end (66) is located at an end of the thread shaft (62) and has a geometric configuration so as to be manipulated by a wrench, a socket too, or any torque applying tool. The opening (64) is centrally located in the end opposite the fastener end (66). The size of the opening (64) corresponds to the size of the head (46) of the pull pin (62), and is adapted to receive the head (46) therein. The slot (68) runs the entire length of the adapter pin (60), extends into the adapter pin (60), and is in communication with the opening (64). The size of the slot (68) corresponds to the size of the shaft (44) of the pull pin (42).

Figure 15:
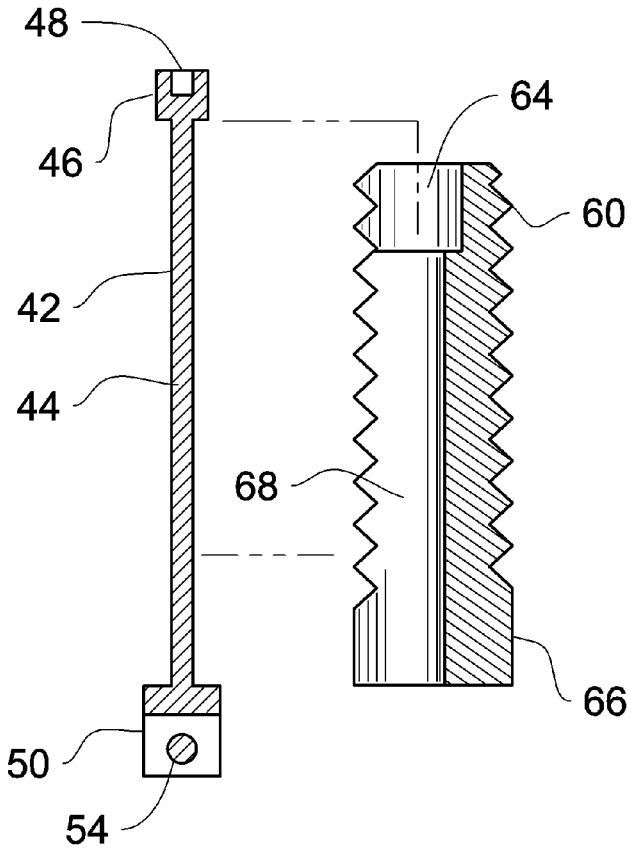
FIG. 15 is an exploded cross sectional view of the pull pin and threaded adapter pin of the hoist system of the present invention taken along line 15 in FIG. 13.
Figure 16:
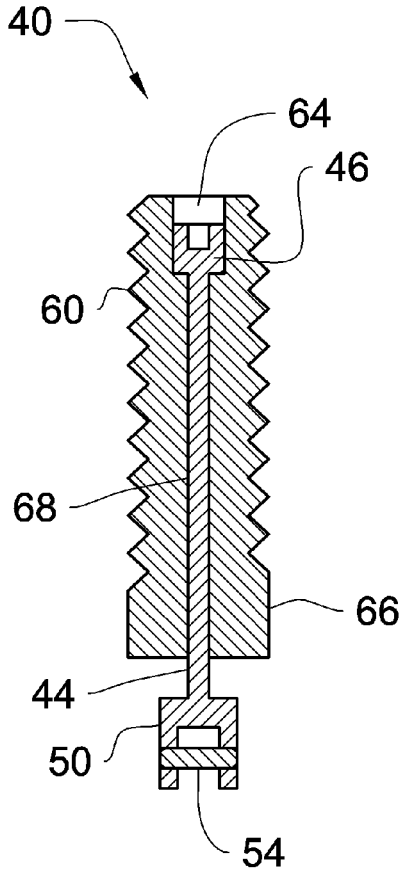
FIG. 16 is a cross sectional view of the pull pin and adapter pin of the hoist system of the present invention taken along line 16 in FIG. 14.

In use, the pull pin shaft (44) is inserted into the slot (68) of the adapter pin (60). Then, the pull pin (42) is oriented so that the head (48) is received within the opening (64) of the adapter pin (60). Since the head (48) and the opening (64) are larger than the pull pin shaft (44) and the adapter pin slot (68), the pull pin (42) and adapter pin (60) are now secured together forming the pull pin assembly (40), as best illustrated in FIGS. 15 and 16. The configuration of the opening (64) and the slot (68) of the adapter pin (60) prevents the pull pin (42) from sliding out. To remove the pull pin (42) from the adapter pin (60), the pull pin (42) must be pushed out from the opening (64) of the adapter pin (60), and then the pull pin shaft (44) can be removed from the slot (68) of the adapter pin (60). The head (48) and pull pin shaft (44) preferably have a generally cylindrical configuration, but any geometric shape can be used. Inherently, opening (64) and slot (68) have configurations that correspond to that of head (48) and pull pin shaft (44).

The adapter pin (60) can be threadably secured to a mounting bore or hole in one of the objects (12, 14), and a wrench or tool can be used on the fastener end (66) to assist in the threading of the adapter pin (60) and pull pin assembly (40).

Figure 17:
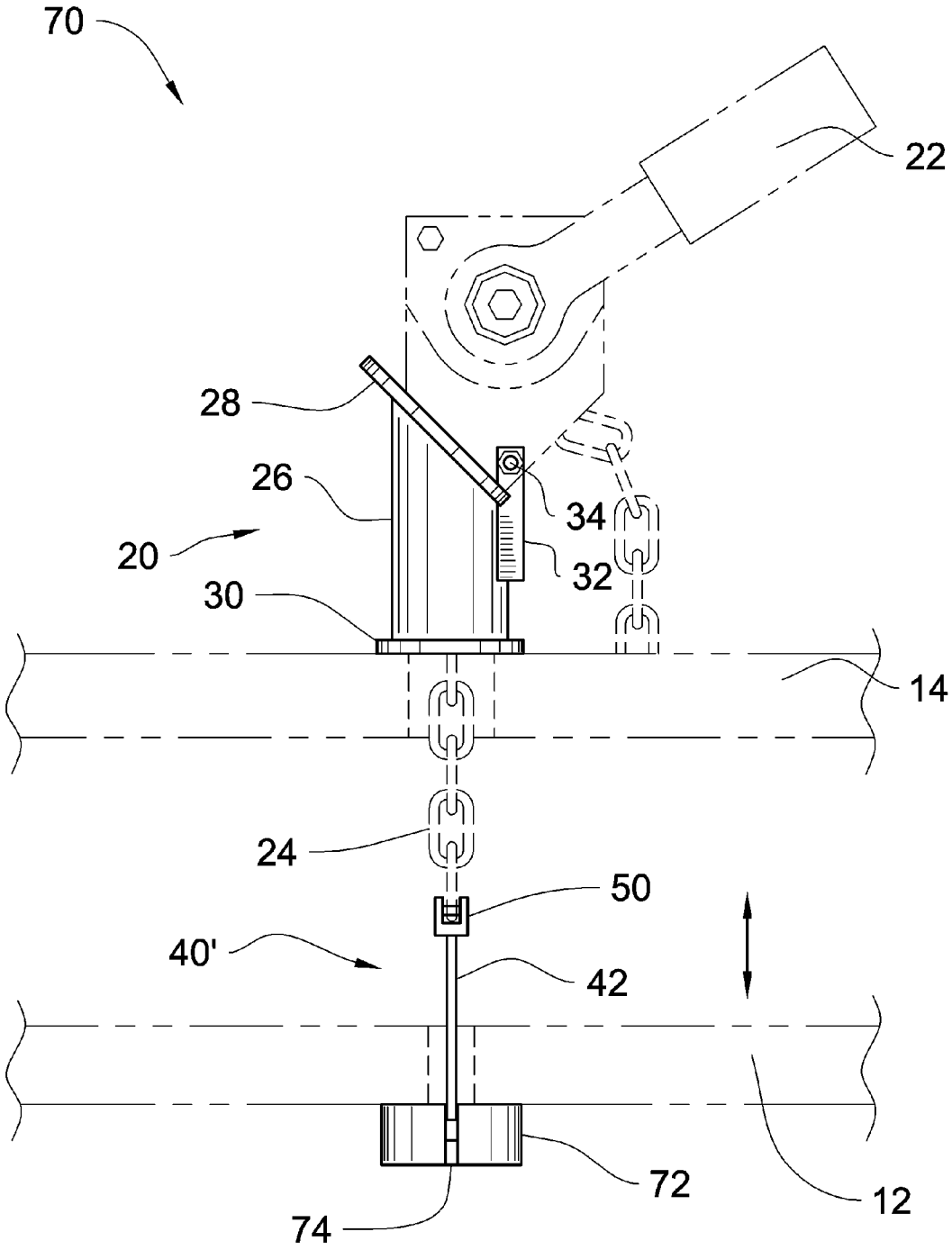
FIG. 17 is a front elevational view of an alternate embodiment of the hoist system of the present invention.

An alternate embodiment and configuration hoist system (70) is illustrated in FIG. 17. In this configuration the hoist adapter unit (20) is position on the upper object (14) with the line (24) passing through the objects (12, 14). The pull pin assembly (40) includes the pull pin (42) described above and a lifting plate (72) which replaces the adapter pin (60). The lifting plate (72) supports the weight of object (12) and is removably attached to the pull pin (42), thereby allowing the lifting plate (72) to raise or lower object (12) in relation to object (14). This configuration is essentially reversed from the configuration shown in FIGS. 1-3.

Referring now to FIG. 18, the lifting plate (72) has a slot (74) extending into the lifting plate (72), and an opening (76) that is in communication with the slot (76). The opening (76) is centrally located in one end of the lifting plate (72), and extends into, but not through, the lifting plate (72). The size of the opening (76) corresponds to the size of the head (46) of the pull pin (62), and is adapted to receive the head (46) therein. The slot (74) runs the entire length of the lifting plate (72), extends into the lifting plate (72), and is in communication with the opening (76). The size of the slot (72) corresponds to the size of the shaft (44) of the pull pin (42).

In use, the pull pin shaft (44) is inserted into the slot (74) of the lifting plate (72). Then, the pull pin (42) is oriented so that the head (48) is received within the opening (76) of the lifting plate (72). Since the head (48) and the lifting plate opening (76) are larger than the pull pin shaft (44) and the lifting plate slot (74), the pull pin (42) and the lifting plate (72) are now secured together forming an alternate embodiment pull pin assembly (40'), as best illustrated in FIGS. 19-21. The configuration of the opening (76) and the slot (74) of the lifting plate (72) prevents the pull pin (42) from sliding out. To remove the pull pin (42) from the lifting plate (72), the pull pin (42) must be pushed out from the opening (76) of the lifting plate (72), and then the pull pin shaft (44) can be removed from the slot (74) of the lifting plate (72). The head (48) and pull pin shaft (44) preferably have a generally cylindrical configuration, but any geometric shape can be used. Inherently, opening (76) and slot (74) have configurations that correspond to that of head (48) and pull pin shaft (44).

Another alternate embodiment pull pin assembly (80) is illustrated in FIGS. 22-25. The pull pin assembly (80) has an expanding pin (82) including a threaded shaft (84), an angled head (83) located at one end of the threaded shaft (84), an attachment end (86) located opposite the angled head (83), a hollow expanding sleeve (90), and a fastener nut (96). The attachment end (86) has a slot to receive the line (24) therein, and a bore to receive and secure a pin (88). The pin (88) can be inserted through an eye of the line or chain (24), thereby removably securing the line or chain (24) to the attachment end (88) of the expanding pin (82). It can be appreciated that the slot can be adapted to receive any size line or chain (24). The angled head (83) tapers outwardly, thereby making the angled head (83) larger than the threaded shaft (84).

The hollow expanding sleeve (90) has a sleeve body (91), at least one slot (92), and an attachment end (94) adjacent the sleeve body (91). The slot (92) is defined in the side of the sleeve body (91), but does not extend all the way down to the attachment end (94). The attachment end (96) is larger than the sleeve body (91). The hollow expanding sleeve (90) is adapted to receive the expanding pin (82) there through. The hollow interior of the hollow expanding sleeve (90) is sized to be larger than the threaded shaft (84) of the expanding pin (82), and smaller that the angled head (83).

The fastener nut (96) is adapted to be threadably secured to the threaded shaft (84) of the expanding pin (82), and to make contact with the attachment end (94) of the hollow expanding sleeve (90).

Figure 23:
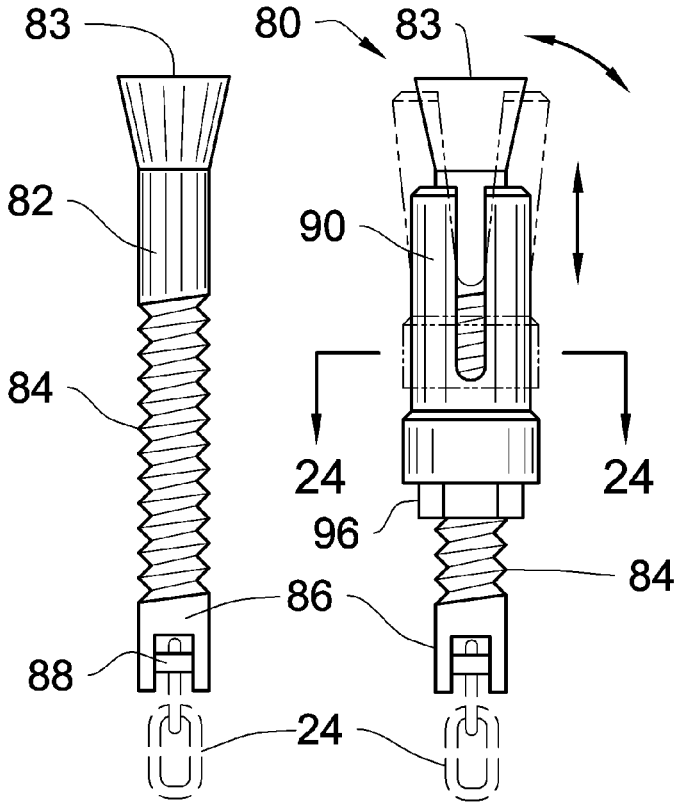
FIG. 23 is a front elevational view of the expanding pin of the hoist system of the present invention.
Figure 24:
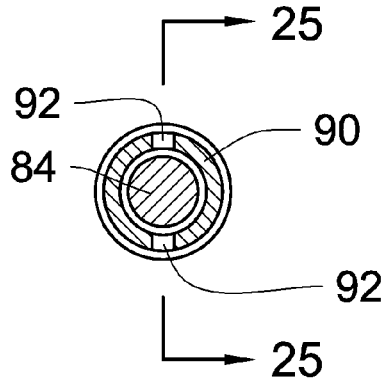
FIG. 24 is a cross sectional view of the expanding pin of the hoist system of the present invention taken along line (24) in FIG. 23.
Figure 22:
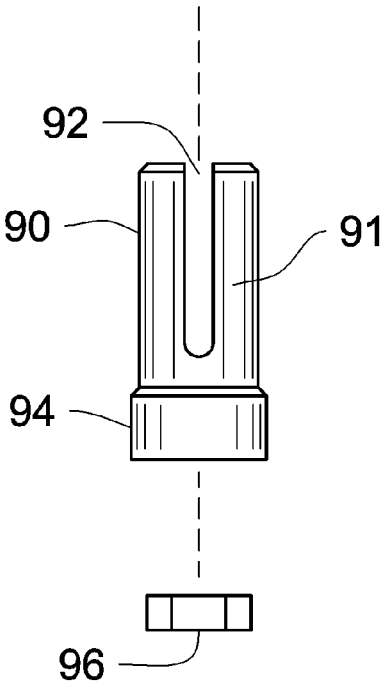
FIG. 22 is an exploded front elevational view of the expanding pin of the hoist system of the present invention.
Figure 25:
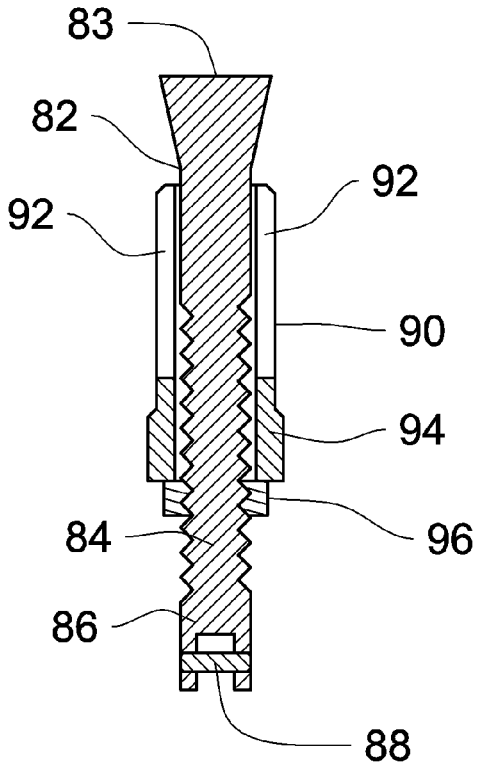
FIG. 25 is a cross sectional view of the expanding pin of the hoist system of the present invention taken along line 25 in FIG. 24.

In use, the expanding pin (82) is inserted into the hollow expanding sleeve (90). Then the fastener nut (96) is threadably secured to the threaded shaft (84) of the expanding pin (82), so as to make contact with the attachment end (94) of the hollow expanding sleeve (90). Continuing advancement of the faster nut (96) will move the hollow expanding sleeve (90) into contact with the larger angled head (83), thereby forcing the sleeve body (91) to expand along the slot (92), as best illustrated in FIG. 23. The attachment end (86) and pin (88) of the expanding pin (82) is removably secured to the line (24) of the hoist (22). The expanding pin (82) and hollow expanding sleeve (90) preferably have a generally cylindrical configuration, but any geometric shape can be used. Inherently, the hollow interior of the hollow expanding sleeve (90) has a configuration that corresponds to that of the threaded shaft (84), and the pull pin assembly (80) is sized to be inserted into the mounting bore or hole of object (12, 14).

The pull pin assembly (80) is first inserted into a mounting bore or hole of object (12, 14), then the fastener nut (96) is advanced to expand the expanding sleeve (90) inside the object (12, 14) mounting bore, thereby securing the pull pin assembly (80) to the object (12, 14). To remove the pull pin assembly (80), the fastener nut (96) is removed thereby removing the hollow expanding sleeve (90) from contact with the angled head (83) of the expanding pin (82) and allowing the sleeve body (91) to return to its standard size.

Figure 26:
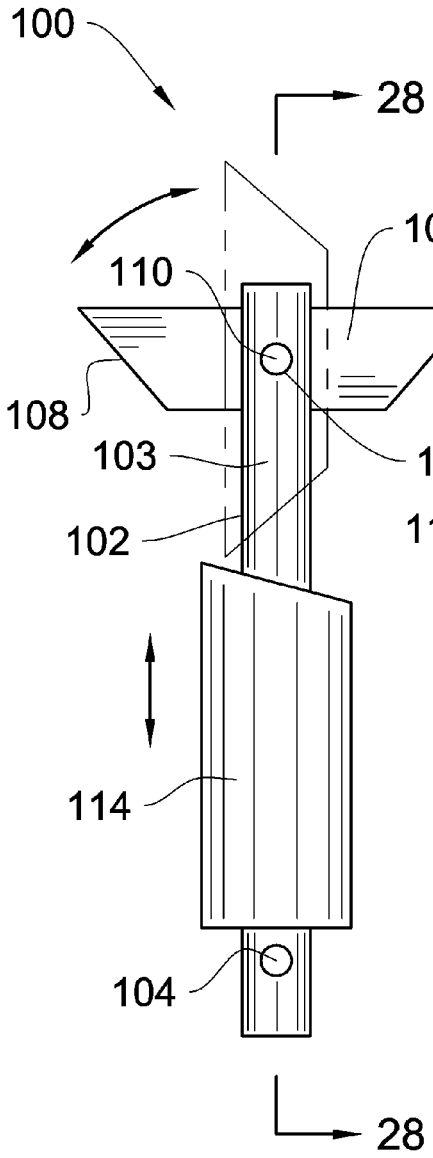
FIG. 26 is a front elevational view of the flip pin of the hoist system of the present invention.
Figure 27:
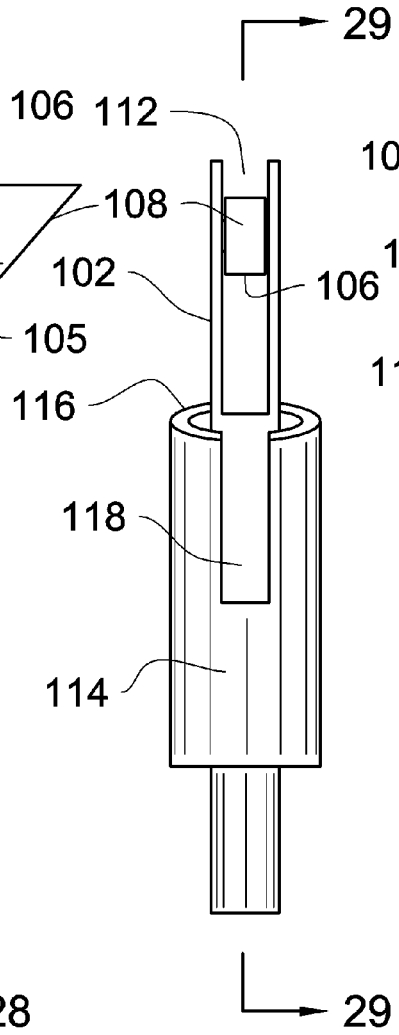
FIG. 27 is a right plane view of the flip pin of the hoist system of the present invention.
Figure 28:
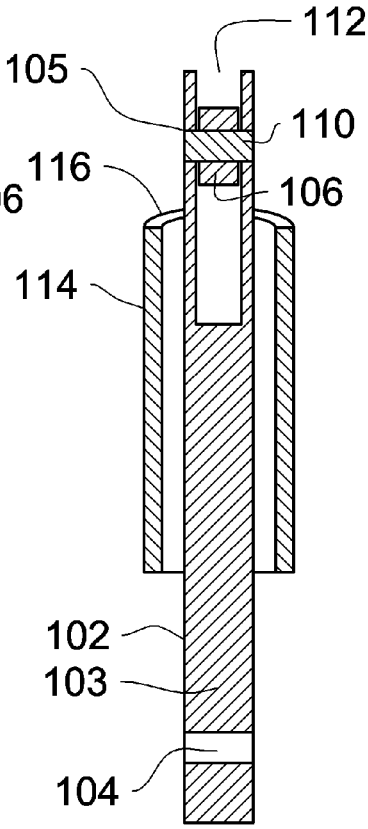
FIG. 28 is a cross sectional view of the flip pin of the hoist system of the present invention taken along line (28) in FIG. 26.
Figure 29:
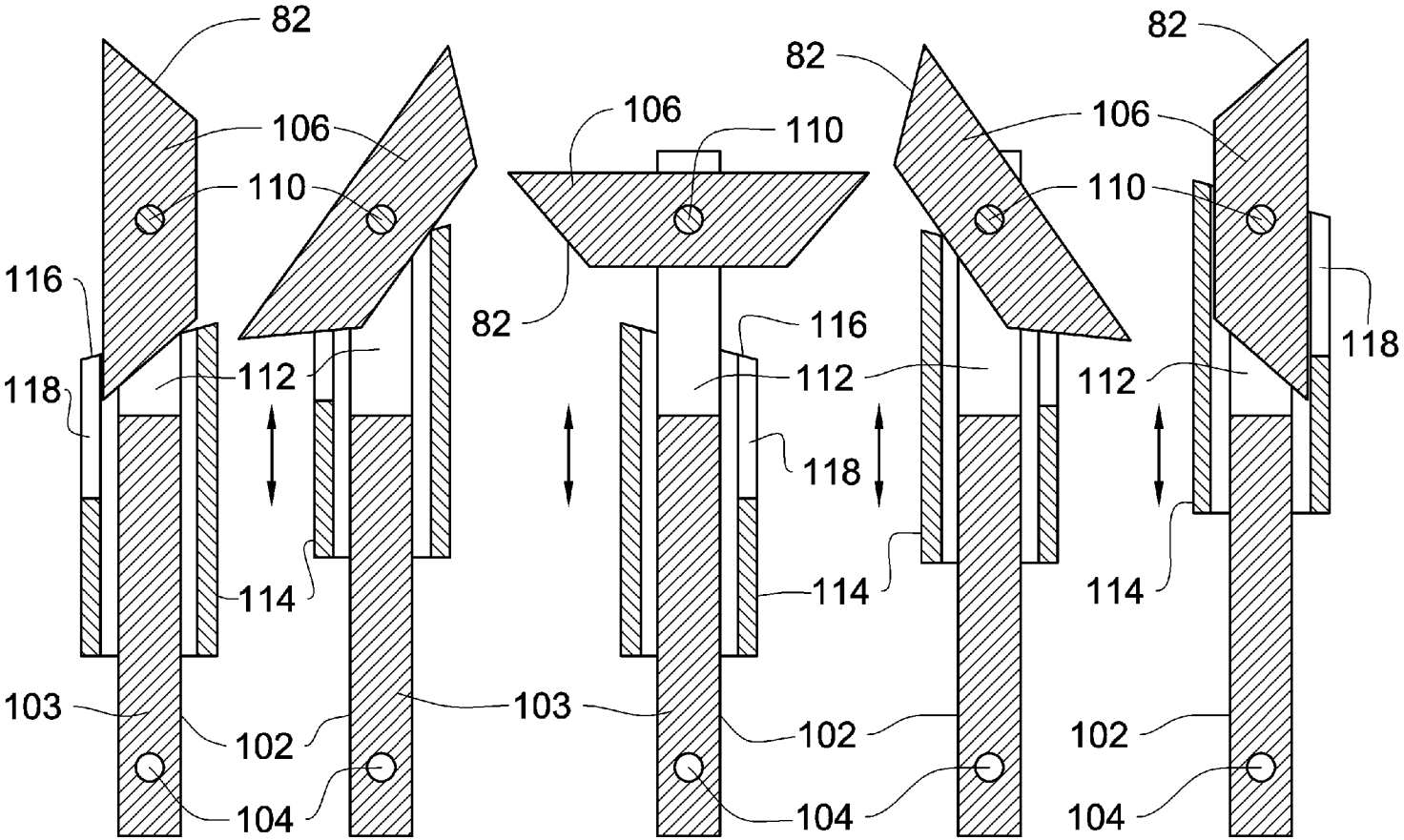
FIG. 29 is a cross sectional in use view of the flip pin of the hoist system of the present invention taken along line 29 in FIG. 27.

Another alternate embodiment pull pin assembly (100) is illustrated in FIGS. 26-28. The pull pin assembly (100) has a flip pin (102), a swiveling arm (106) pivotably attached to the flip pin (102), and a sleeve (114) adapted to slidably receive the flip pin (102) therein. The flip pin (102) includes a pin body (103), an attachment end (104), a slot (112) defined opposite of the attachment end (104), and a bore (105) defined through the pin body (103) and in communication with the slot (112). The attachment end (104) is adapted to be removably secured to the line (24) of the hoist (22).

The swiveling arm (106) has at least one angled side (108) and is adapted to be received in and pass through the slot (112) of the flip pin (102). The swiveling arm (106) is pivotably connected to the pin body (103) by a pivot pin (110) that is inserted in the bore (105) of the flip pin (102). The swiveling arm (106) is wider than the width of the pin body (103), as best illustrated in FIG. 26.

The sleeve (114) has a top end (116), and a slot (118) defined along the side of the sleeve (114). The slot (118) extends from the top end (116) down along the side of the sleeve (114), but does not extend the entire length of the sleeve (114). The sleeve (114) is hollow and is adaptively sized to receive the flip pin (102) and the swiveling arm (106) therein, but also sized to allow the sleeve (114) to be positioned on the flip pin (102) so as to allow the top end (116) to make contact with the portion of the swiveling arm (106) extending out past the flip pin (102) when the swiveling arm (106) is positioned in the flip pin slot (112). The sleeve slot (118) is adaptively sized to allow the swiveling arm (106) to pass therethrough.

In use, the flip pin (102) is inserted into the sleeve (114), while the swiveling arm (106) is pivoted so as to have the angled side (108) longitudinally aligned with the flip pin (102) and positioned in the flip pin slot (112). Then the sleeve (114) is positioned over the swiveling arm (106) so as to secure it therein. The pull pin assembly (100) is then inserted through a mounting bore or hole of object (12, 14). Once inserted, the sleeve (114) is oriented so as to allow the sleeve top end (116) to come in contact with the angled side (108). Advancing the sleeve (114) forces the swiveling arm (106) to pivot about pivot pin (110), and thereby positioning the swiveling arm (106) so that its width is larger than the mounting bore of the object (12, 14). This position secures the pull pin (100) in the object (12, 14). Inherently, the hollow interior of the sleeve (114) has a configuration that corresponds to that of the flip pin (102) and the swiveling arm (106).

The pull pin assembly (100) is removed from the mounting bore or hole of object (12, 14) by rotating the sleeve (114) so that the sleeve slot (118) is aligned with the angled side (118) of the swiveling arm (106). The sleeve (106) is then advanced to so that the top end (116) makes contact with the longitudinal side of the swiveling arm (106), thereby forcing the swiveling arm (106) to pivot about pivot pin (110), and thereby positioning the swiveling arm (106) so that its angled side (108) passes through the sleeve slot (118) and is longitudinally aligned with the flip pin (102) and positioned in the flip pin slot (112). The pull pin assembly (100) is now configured to be smaller than the mounting bore or hole of the object (12, 14), and can be removed.

Figure 30:
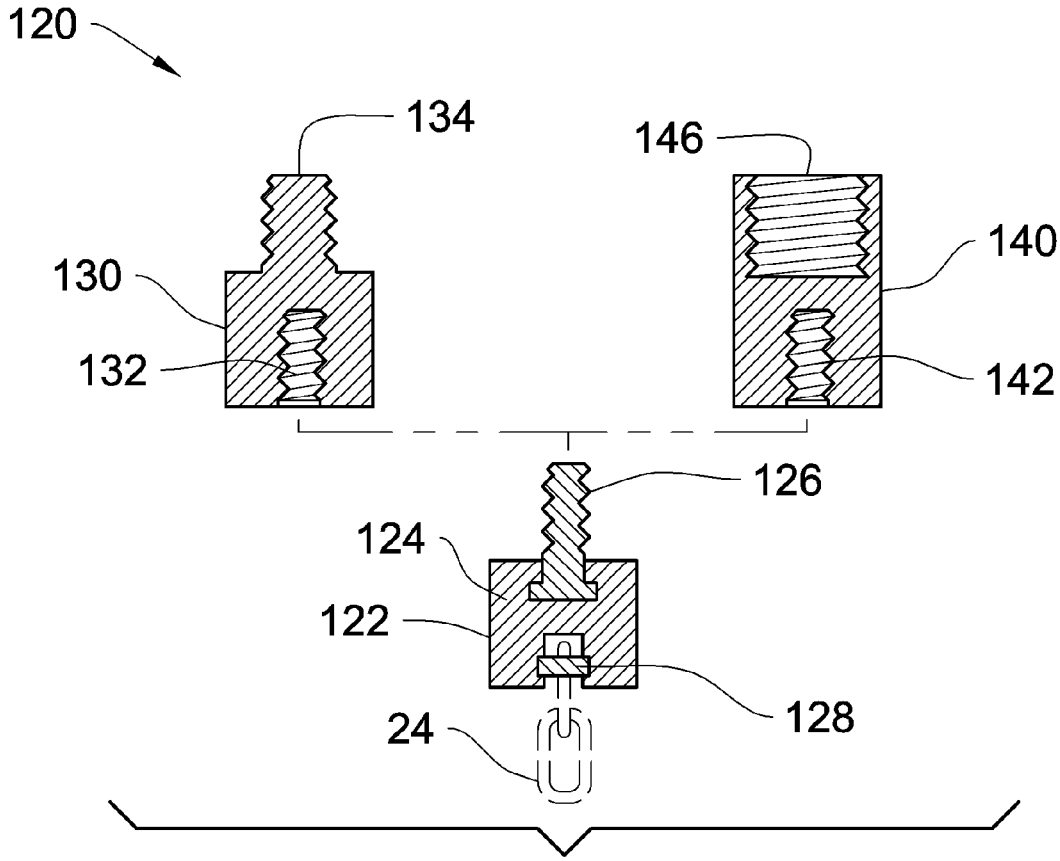
FIG. 30 is a cross sectional view of an alternate embodiment of the adapter pin of the hoist system of the present invention.

Another alternate embodiment pull pin assembly (120) is illustrated in FIG. 30. The pull pin assembly (120) has a swiveling pin (122) and mounting adapters (130, 140). The swiveling pin (122) includes a pin body (124), a threaded stud (126) swivelably attached to the pin body (124), and an attachment end (128). The attachment end (128) is adapted to receive and secure the line (24) of the hoist (22) to the swiveling pin (122).

The mounting adapters (130, 140) both have an internally threaded bore therein (132, 142) which is adapted to be threadably secured to the threaded stud (126) of the swiveling pin (122). The mounting adapter (130) includes a threaded stud (134) extending out therefrom, and is adapted to be threadably secured to the mounting bore or hole of the object (12, 14). The mounting adapter (140) includes an additional internally threaded bore (146) opposite the internally threaded bore (142). The internally threaded bore (146) is adapted to be threadably secured to a thread stud or fastener extending from object (12, 14). It can be appreciated that the mounting adapters (130, 140) are interchangeable with the swiveling pin (122).

Figure 31:
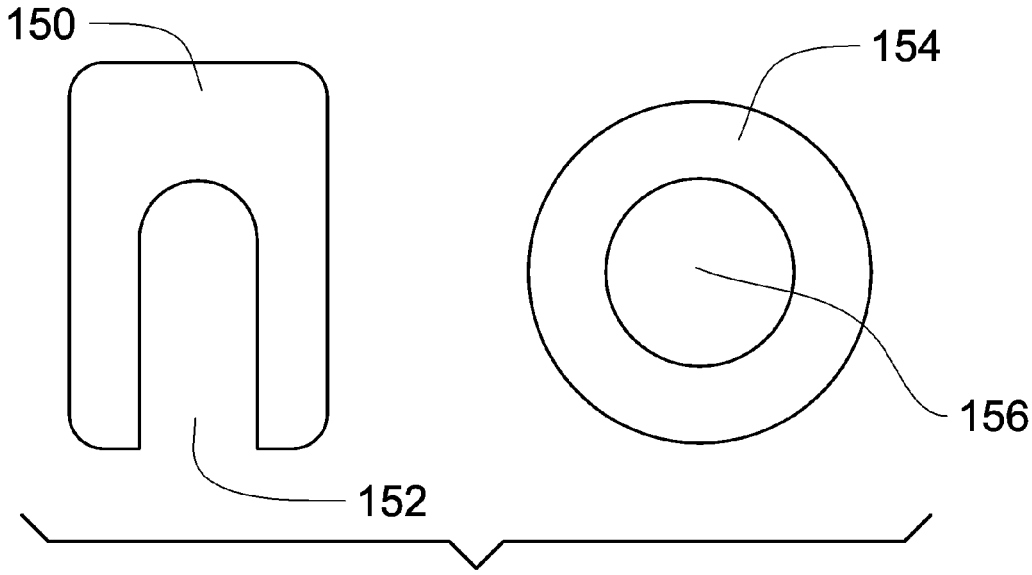
FIG. 31 is a top elevational view an alternate embodiment of the hoist adapter unit of the hoist system of the present invention.

Alternate embodiments hoist adapter units (150, 154) are illustrated in FIG. 31, and which include varying configurations of openings (152, 156)

In use, it can now be understood that the hoist system (10) constructed to be used to raise, lower, or apply a pulling force of one object in relation to another object. A user would first attach the hoist adapter unit (20) to the hoist (22) with the hoist line (24) passing therethrough. The hoist line (24) is then attached to the attachment end (50, 86, 104, 128) of the pull pin assembly (40, 40', 80, 100, 120). The pull pin assembly (40, 40', 80, 100, 120) is then inserted or attached to a mounting bore, hole, or attachment portion of an object (12, 14). Then the hoist adapter unit (20) is then positioned to be in contact with the other object (12, 14), with the hoist line (24) passing through the object (12, 14). The user would then operate the hoist (22) to either raise, lower, or apply a pulling force to the object (12, 14). The hoist (22) could be either manually powered or motorized.

The user can use multiple hoist systems (10) if the object (12, 14) is to large or heavy for being operated by one hoist system (10).

It can therefore be appreciated that the use of the hoist system (10) would significantly increase safety and decrease labor when used, as compared to other hoist, lifts, and jack systems.

While a preferred embodiment of the hoist system has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal, plastic, or composites may be used instead of the material described. And although hoist, lifting, and jack systems for raising, lowering, or applying a pulling force to an object attached thereto have been described, it should be appreciated that the hoist system herein described is also suitable for environments not described in this application.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hoist system for moving a first object in relation to a second object, said hoist system comprising:

a hoist having a frame and a line;

a hoist adapter unit removably attachable to said hoist, said adapter unit being configured to contact one of said objects; and a pull pin assembly removably attachable to said line of said hoist and to said object other than said object in contact with said hoist adapter;

wherein said hoist adapter unit having a hollow body adapted to receive said pull pin assembly.

2. The hoist system as set forth in claim 1, wherein said hoist adapter unit further comprising a top plate, a bottom plate, and a mounting plate, said mounting plate having a hole defined therethrough to receive a fastener from said frame of said hoist thereby removably attaching said adapter unit to said hoist, said top and bottom plates each having an opening defined therein to receive said line of said hoist therethrough, and wherein said hollow body and said openings in said top and bottom plates are adapted to receive said pull pin assembly.

3. The hoist system as set forth in claim 2, wherein said bottom plate being orientated at an angle corresponding to said frame of said hoist.

4. The hoist system as set forth in claim 2, wherein said pull pin assembly has a pull pin and at least one adapter pin, said pull pin being removably attachable to said line of said hoist, said adapter pin being removably attachable to said pull pin and to said other object.

5. The hoist system as set forth in claim 4, wherein said pull pin having a head, a shaft, and an attachment end, said shaft having a smaller thickness than said head, and said attachment end of said pull pin being removably attachable to said line of said hoist.

6. The hoist system as set forth in claim 5, wherein said adapter pin has a threaded shaft, a fastener end, a slot defined in said adapter pin, and an opening defined in said threaded shaft opposite said fastener end and which is communication with said slot, said threaded shaft being adapted to be threadably secured to a mounting bore in said object opposite said object attached to said hoist adapter unit.

7. The hoist system as set forth in claim 6, wherein said opening in said threaded shaft is configured to receive said head of said pull pin, said slot is configured to receive said shaft of said pull pin thereby removably securing said adapter pin to said pull pin.

8. The hoist system as set forth in claim 7, wherein said fastener end being configured so as to be manipulated by a torque tool.

9. The hoist system as set forth in claim 5, wherein said adapter pin is a lifting plate having a centrally located opening defined into said lifting plate and a slot in communication with said opening, said opening being adapted to receive said head of said pull pin, said slot being adapted to receive said shaft of said pull pin, and wherein said lifting plate being contact with said object other than said object in contact with said hoist adapter unit.

10. The hoist system as set forth in claim 2, wherein said pull pin assembly is an expanding pin having a pull pin, a hollow expanding sleeve, and a fastener nut, said pull pin has a threaded shaft, an angled head, and an attachment end attachable to said line of said hoist, said hollow expanding sleeve having at least one slot defined along its side, said hollow expanding sleeve being adapted to receive said pull pin therein, said fastener nut being threadably engagable with said threaded shaft of said pull pin and in contact with said hollow expanding sleeve so as to force said hollow expanding sleeve against said angled head whereby said angled head expands said hollow expanding sleeve.

11. The hoist system as set forth in claim 10, wherein said expanding pin is adapted to be inserted into a mounting bore in said object other than said object attached to said hoist adapter unit.

12. The hoist system as set forth in claim 2, wherein said pull pin assembly is a flip pin having a pin body, a swiveling arm, and a sleeve, said pin body having an attachment end, a slot defined opposite of said attachment end, and a bore defined through said pin body and in communication with said slot, said swiveling arm being pivotably attached to said pin body by a pivot pin inserted in said bore and said swiveling arm being receivable in said slot, said sleeve having a slot defined therein and said sleeve being slidable over said pin body and swiveling arm, said attachment end being attachable to said line of said hoist, and said flip pin being adapted to be inserted into a mounting bore in said object other than said object in contact with said hoist adapter unit.

13. The hoist system as set forth in claim 12, wherein said swiveling arm is larger than said pin body allowing said sleeve to force said swiveling arm to pivot when said sleeve comes into contact with the portion of said swiveling arm that extends out from said pin body when said swiveling arm is received in said slot of said pin body.

14. The hoist system as set forth in claim 2, wherein said pull pin assembly is a swiveling pin having a pin body, a threaded stud swivelably attached to said pin body, an attachment end, and a mounting adapter threadably attachable to said threaded stud, said mounting adapter being adapted to be threadably secured to said object other than said object in contact with said hoist adapter, said attachment end being attachable to said line of said hoist.

15. A hoist system comprising:

a hoist adapter unit removably attachable to a hoist, said hoist adapter unit having a hollow body, a top plate, a bottom plate, and a mounting plate, said mounting plate having a hole defined therethrough to receive a fastener from said hoist, said top and bottom plates having an opening defined therethrough to receive a line of said hoist, said top plate being configured to contact one of said objects, said bottom plate being configured to contact a frame of said hoist; and a pull pin assembly removably attachable to said line of said hoist and to said object other than said object in contact with said hoist adapter;

wherein said hollow body and said openings in said top and bottom plates are adapted to receive said pull pin assembly therein.

16. The hoist system as set forth in claim 15, wherein said pull pin assembly is an expanding pin having a pull pin, an hollow expanding sleeve, and a fastener nut, said pull pin having a threaded shaft, an angled head, and an attachment end attachable to said line of said hoist, said expanding sleeve having at least one slot defined along its side, said hollow expanding sleeve being adapted to receive said pull pin therein, said fastener nut being threadably engagable with said threaded shaft of said pull pin and in contact with said hollow expanding sleeve so as to force said hollow expanding sleeve against said angled head whereby said angled head expands said hollow expanding sleeve, and wherein said expanding pin is adapted to be inserted into a mounting hole in said object other than said object attached to said hoist adapter unit.

17. The hoist system as set forth in claim 15, wherein said pull pin assembly is a flip pin having a pin body, a swiveling arm, and a sleeve, said pin body having an attachment end, a slot defined opposite of said attachment end, and a bore defined through said pin body and in communication with said slot, said swiveling arm being pivotably attached to said pin body by a pivot pin inserted in said bore and said swiveling arm being receivable in said slot, said sleeve having a slot defined therein and said sleeve being slidable over said pin body and swiveling arm, said attachment end being attachable to said line of said hoist, and said flip pin being adapted to be inserted into a mounting hole in said object other than said object in contact with said hoist adapter unit.

18. The hoist system as set forth in claim 17, wherein said swiveling arm is larger than said pin body allowing said sleeve to force said swiveling arm to pivot when said sleeve comes into contact with the portion of said swiveling arm that extends out from said pin body when said swiveling arm is received in said slot of said pin body.

19. The hoist system as set forth in claim 17, wherein said pull pin assembly is a swiveling pin having a pin body, a threaded stud swivelably attached to said pin body, an attachment end, and a mounting adapter threadably attachable to said threaded stud, said mounting adapter being adapted to be threadably secured to said object other than said object in contact with said hoist adapter, said attachment end being attachable to said line of said hoist.

20. A hoist system comprising:

a hoist having a frame and a line;

a hoist adapter unit having a hollow body, a top plate, a bottom plate, and a mounting plate, said mounting plate having a hole defined therethrough to receive a fastener from said hoist, said top and bottom plates having an opening defined therethrough to receive said line of said hoist, said hoist adapter unit being removably attachable to said hoist, said top plate being configured to contact one of said objects, said bottom plate being configured to contact said frame of said hoist; and a pull pin assembly having a pin body, a swiveling arm, and a sleeve, said pin body having an attachment end, a slot defined opposite of said attachment end, and a bore defined through said pin body and in communication with said slot, said swiveling arm being pivotably attached to said pin body by a pivot pin inserted in said bore and said swiveling arm being receivable in said slot, said sleeve having a slot defined therein and said sleeve being slidable over said pin body and swiveling arm, said attachment end being removably attachable to said line of said hoist, and said flip pin being adapted to be inserted into a mounting hole in said object other than said object in contact with said hoist adapter unit;

wherein said hollow body and said openings in said top and bottom plates are adapted to receive said pull pin assembly therein;

wherein said swiveling arm is larger than said pin body allowing said sleeve to force said swiveling arm to pivot when said sleeve comes into contact with the portion of said swiveling arm that extends out from said pin body when said swiveling arm is received in said slot of said pin body.

* * * * *